US007731527B2

(12) United States Patent
Hiramatsu

(10) Patent No.: US 7,731,527 B2
(45) Date of Patent: Jun. 8, 2010

(54) CONNECTOR WITH CHANNELS HAVING CONCAVE GROOVES FACING INTO CONNECTOR AND CONVEX SUPPORT SURFACES FOR MOUNTING ON SUBSTRATE

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/393,364

(22) Filed: Feb. 26, 2009

(65) Prior Publication Data

US 2009/0239414 A1 Sep. 24, 2009

(30) Foreign Application Priority Data

Mar. 20, 2008 (JP) ..... 2008-072653

(51) Int. Cl.
*H01R 13/73* (2006.01)

(52) U.S. Cl. ..... 439/571

(58) Field of Classification Search ..... 439/571, 439/607.38, 569, 453, 365; 385/53, 453
See application file for complete search history.

(56) References Cited

U.S. PATENT DOCUMENTS 5,685,739 A * 11/1997 Davis et al. ..... 439/607.38
6,632,023 B1 * 10/2003 Ogawa et al. ..... 385/53

FOREIGN PATENT DOCUMENTS

JP 2001-085091 3/2001
JP 2003-142209 5/2003

* cited by examiner

*Primary Examiner*—Chandrika Prasad
(74) *Attorney, Agent, or Firm*—Gerald E. Hespos; Michael J. Porco

(57) ABSTRACT

A connector (10) for a substrate has a tubular hood (21) in which at least one mating housing can be fit. The hood (21) is mounted on a surface of a circuit substrate (90). Channels (45, 46) are formed in a bottom wall (22) of the hood (21) and define grooves opening into the hood (21) for preventing the mating housings from being fitted in wrong fit-in concavities (28) of the hood (21). The channels (45, 46) have flat bottom surfaces that contact and extend along the circuit substrate (90) for stably supporting the hood (10) while spacing the bottom wall (22) from the circuit substrate (90).

21 Claims, 8 Drawing Sheets

CONNECTOR WITH CHANNELS HAVING CONCAVE GROOVES FACING INTO CONNECTOR AND CONVEX SUPPORT SURFACES FOR MOUNTING ON SUBSTRATE

BACKGROUND OF THE INVENTION

1. Field of the Invention

The invention relates to a connector for a substrate.

2. Description of the Related Art

Japanese Patent Application Laid-Open No. 2001-085091 discloses a connector for a substrate. The connector has a square pillar-shaped hood in which a mating housing can be fit. The hood is mounted on the upper surface of the circuit substrate (printed-wiring substrate) and terminal fittings mounted in the hood are connected to conductive paths of the circuit substrate by soldering.

A supporting wall is formed at the rear end of the bottom surface of the hood and extends in the widthwise direction of the hood. A lower surface of the supporting wall contacts the upper surface of the circuit substrate and through-holes are formed at the widthwise ends of the supporting wall. Bolts are passed through the through-holes and are tightened to fix the hood to the circuit substrate.

The bottom surface of the supporting wall of the hood defines a dedicated supporting construction for the connector disclosed in Japanese Patent Application Laid-Open No. 2003-142209, and hence there is a required material cost for this supporting construction. The electrical connector industry is very competitive, and excess costs are always a concern. Consideration has been given to omitting the supporting wall so that the entire bottom surface of the hood contacts the circuit substrate. However, the hood is susceptible to thermal effects from the circuit substrate in a high-temperature environment where reflow soldering or the like is used. Consequently there is a fear that the hood may be deformed by thermal expansion and may not be supported stably by the circuit substrate.

The invention has been completed in view of the above-described situation. Therefore an object of the invention is to provide a connector for a substrate without a high production cost for the supporting construction for the circuit substrate while ensuring that a hood of the connector is supported stably by the circuit substrate.

SUMMARY OF THE INVENTION

The invention relates to a connector for a substrate. The connector includes a tubular hood with concavities for receiving mating housings. The hood is mounted on a surface of a circuit substrate. The hood includes a bottom wall and channels project outward from the bottom wall at both widthwise sides of a bottom wall of the hood. The channels extend in a longitudinal direction of the hood and have concave grooves that face into the hood. The channels prevent mating housings from being fit in wrong fit-in concavities of the hood. Convex external surfaces of the channels face outwardly and contact the surface of the circuit substrate. As a result, the connector need not have a dedicated support for the circuit substrate and the construction of the hood is not complicated. Therefore, it is possible to save material and reduce costs. Further, the hood will be affected thermally to a lower extent by the circuit substrate than the construction in which the bottom surface of the hood entirely contacts the circuit substrate. This construction also supports the hood stably supported on the circuit substrate.

The lower surface of the channel preferably has a concave region and a mounting portion that projects down from the concave region on the lower surface of the channel. The mounting portion is configured to be locked elastically to a peripheral edge of a through-hole in the circuit substrate for preventing the hood from being removed from the circuit substrate. Thus, space can be utilized more efficiently than a construction in which the mounting portion is at a position separate from the channel. Further, the material cost can be saved because a part of the projected amount of the mounting portion is covered by the channel.

A wide hood could be warped by an external force. Therefore, the hood preferably includes at least one channel at a widthwise middle position of the hood. The channel formed at the widthwise middle position of the hood prevents the hood part from being warped in response to an external force.

An outer surface of each channel preferably is flat and extends along a surface of the circuit substrate. Thus, the height of the channels is small and the hood is compact compared with the case where end surfaces of the channels define arcs. Further the hood can be supported stably by the circuit substrate.

A reinforcement preferably is formed at a middle position of the bottom surface of the bottom wall of the hood in the widthwise direction thereof. The reinforcement has a bottom surface that is flush with or higher than bottom surfaces of the channels. The reinforcement prevents the hood from being warped by heat or an external force.

DETAILED DESCRIPTION OF THE PREFERRED EMBODIMENTS

Figure 1:
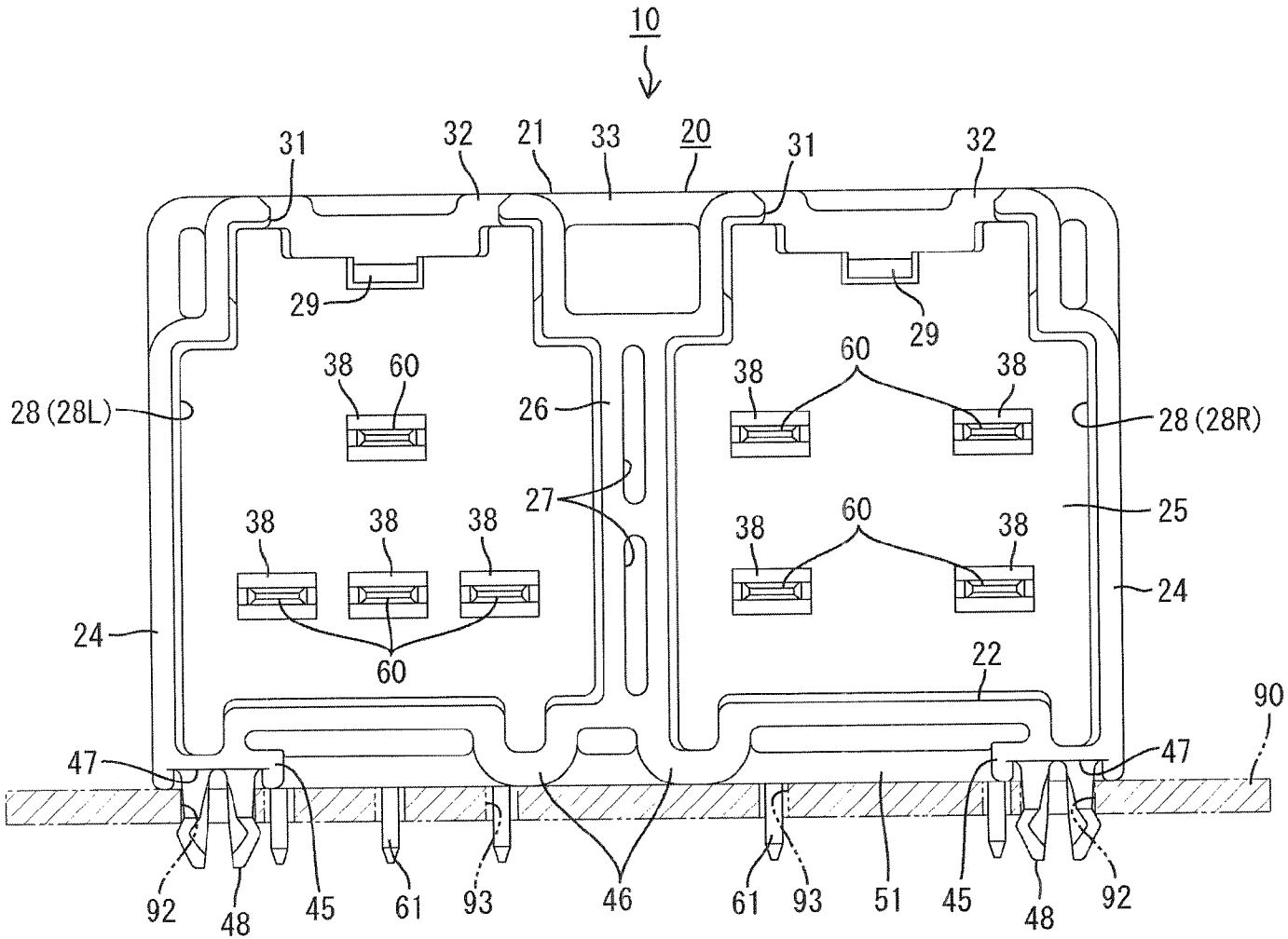
FIG. 1 is a front view of a connector for a substrate according to the invention.

A connector in accordance with the invention is identified by the numeral 10 in FIGS. 1 through 8 and is mounted on a surface of a circuit substrate (printed-wiring substrate) 90. The connector 10 includes a housing 20 and terminal fittings 60. The housing 20 is configured to receive mating housings (not shown).

The housing 20 is made unitarily of a synthetic resin and includes a hood 21. The hood 21 defines a square pillar-shape and is long and narrow in a widthwise direction (right-to-left direction in the drawings). The hood 21 has a bottom wall 22, an upper wall 23, left and right side walls 24, a rear wall 25, and a partitioning wall 26 disposed between the side walls 24. The partitioning wall 26 is thicker than both side walls 24 and has a thinned spatial portion 27. The hood 21 has forwardly open left and right fit-in concavities 28 disposed at both sides of the partitioning wall 26. Mating housings corresponding to the left and right fit-in concavities 28 can be fit therein from the front. The configurations of both mating housings are different from each other. Therefore, inner configurations of the left and right fit-in concavities 28 differ from each other according to the configurations of the mating housings. Inner configurations of the left and right fit-in concavities 28 are described in detail later.

Figure 5:
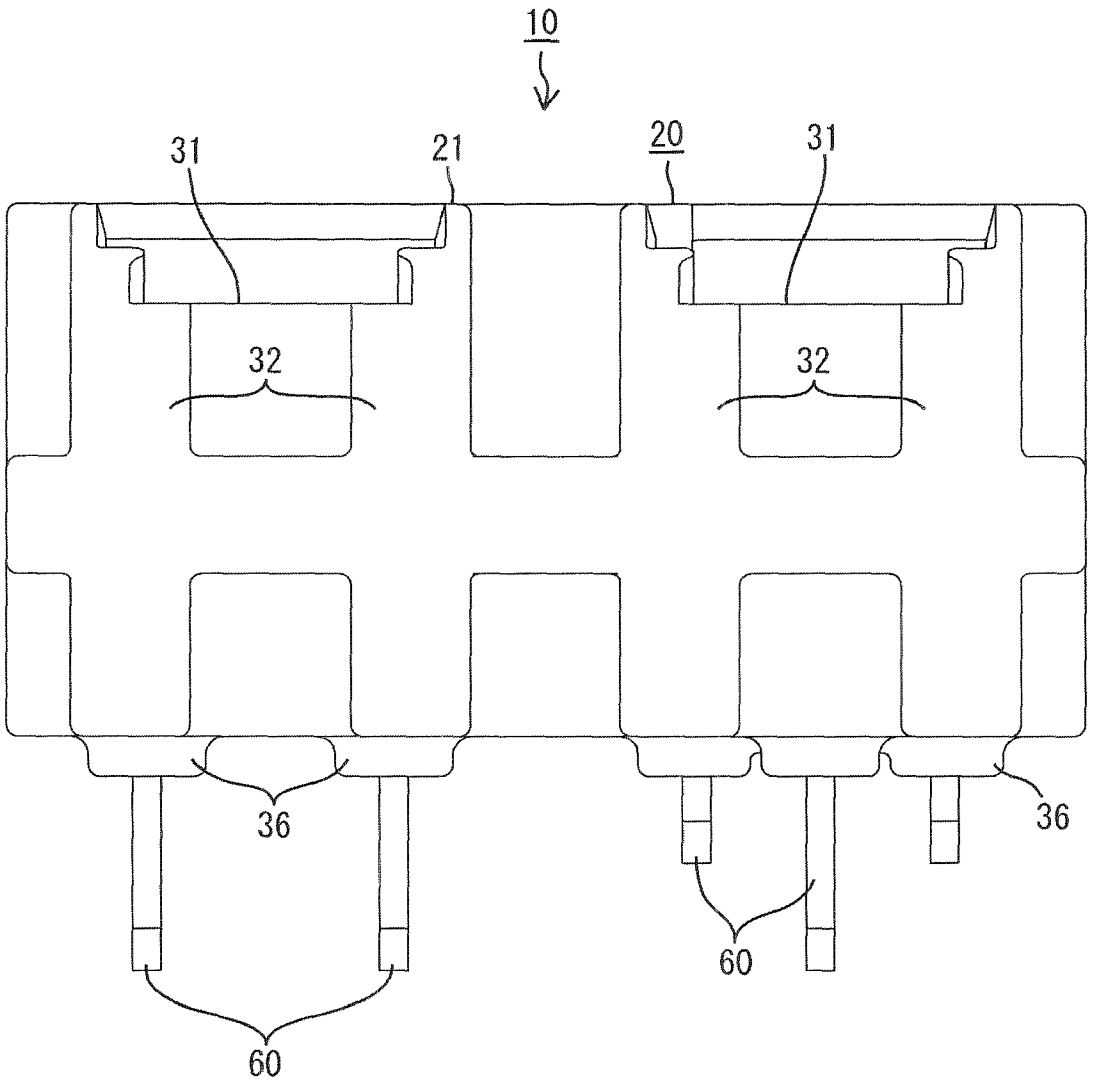
FIG. 5 is a plan view of the connector for the substrate.

A locking convex portion 29 is formed at a widthwise central portion of the upper wall 23 (see FIG. 2) of each of the left and right fit-in concavities 28 and is capable of locking the mating housings. As shown in FIG. 5, an escape concavity 31 is formed at a front end of the upper wall 23 of each of the fit-in concavities 28 by cutting out the upper wall 23. The locking convex portion 29 is disposed immediately rearward from the escape concavity 31. Left and right guide grooves 32 are formed in the upper wall 23 of each of the fit-in concavities 28 with the left locking convex portion 29 interposed between the left guide grooves 32 and with the right locking convex portion 29 interposed between the right guide grooves 32. Each guide groove 32 extends on the upper surface of the hood 21 in a longitudinal direction of the housing 20 (the direction in which the mating housings are fit in and remove from the housing 20) by projecting the guide groove 32 up from the upper surface of the hood 21. A guide rib is formed on each of the mating housings and can be fit in each guide groove 32. An upper surface of each guide groove 32 is approximately horizontal and flat over the full length of the upper surface of the hood 21 in the longitudinal direction thereof. An upper reinforcing rib 33 is formed on the upper surface of the upper wall 21 and extends in the widthwise direction of the hood 21 at a position slightly rearward from the longitudinal center of the upper surface of the upper wall 23. The upper reinforcing rib 33 extends over the entire width of the upper wall 23 and intersects each guide groove 32 at approximately a right angle therewith. An upper-end surface of the upper reinforcing rib 33 is approximately horizontal, flat, continuous and flush with the upper-end surface of the guide groove 32.

Mounting holes 35 are formed on the rear wall 25 of each of the fit-in concavities 28 where the terminal fittings 60 are mounted respectively. Tubular portions 36 project rearward from a rear surface of the rear wall 25 at positions corresponding to the mounting holes 35. The tubular portions 36 effectively lengthen the mounting hole 35 to provide better support for the terminal fittings 60. The arrangement of the mounting holes 35 in one fit-in concavity 28 is different from the arrangement of the mounting holes 35 in the other fit-in concavity 28.

Figure 2:
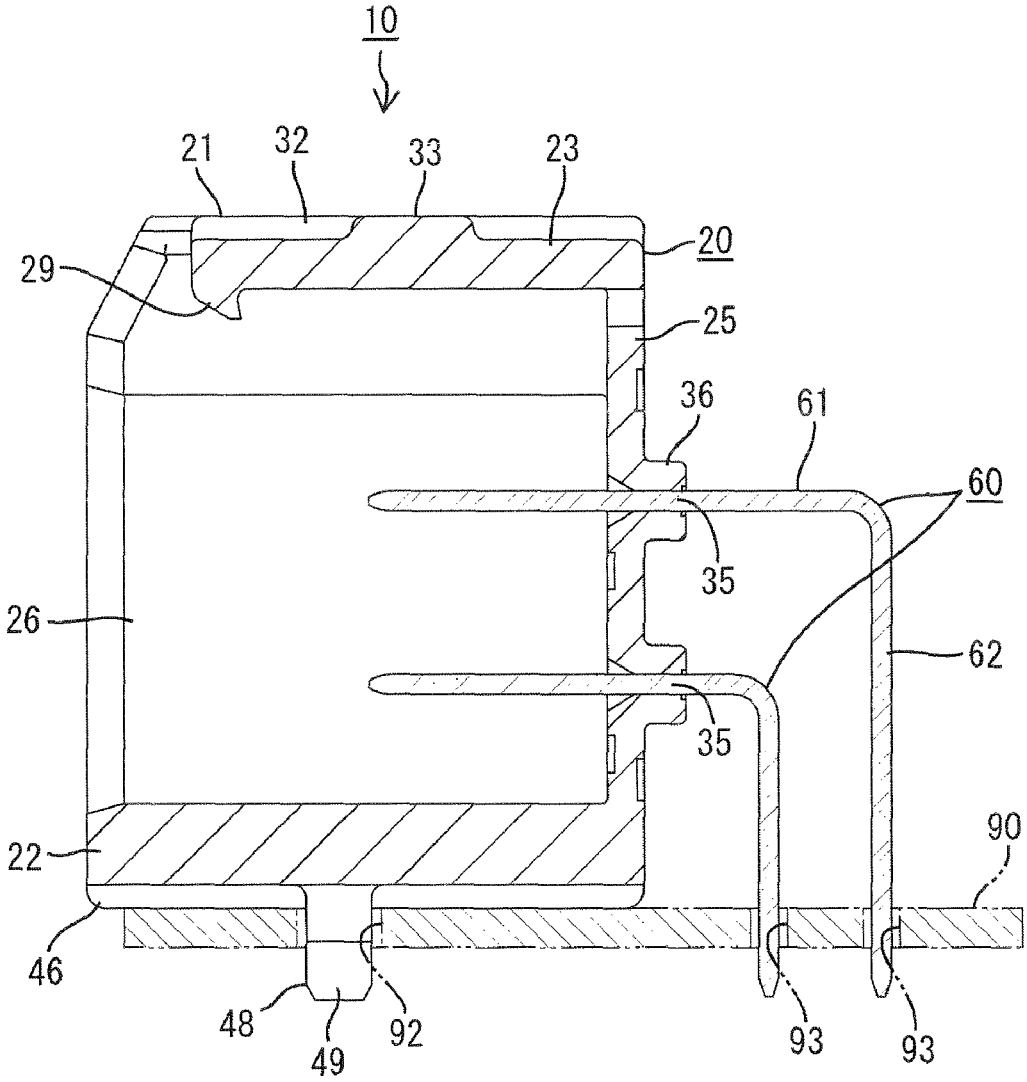
FIG. 2 is a side sectional view of the connector for the substrate.

Each terminal fitting 60 is formed by bending a conductive metal plate to define a long narrow horizontal part 61 and a long narrow vertical part 62, as shown in FIG. 2. The terminal fitting 60 is widthwise flat except a portion thereof to be exposed from the rear wall 25. The terminal fitting 60 is inserted into the mounting hole 35 from the front prior to bending. Thereafter a portion of the terminal fitting 60 that projects rearward from the rear wall 25 is bent down to form the vertical part 62.

Figure 6:
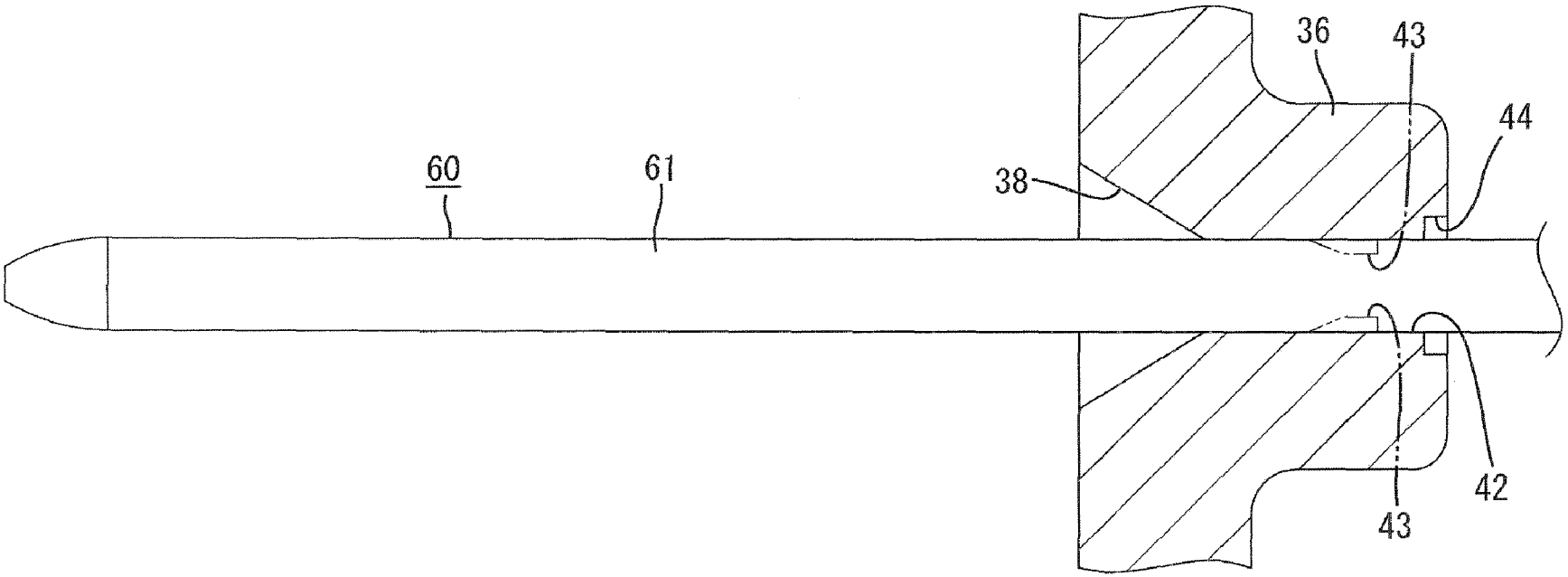
FIG. 6 is an enlarged side sectional view of a mounting hole into which a terminal fitting is inserted.
Figure 7:
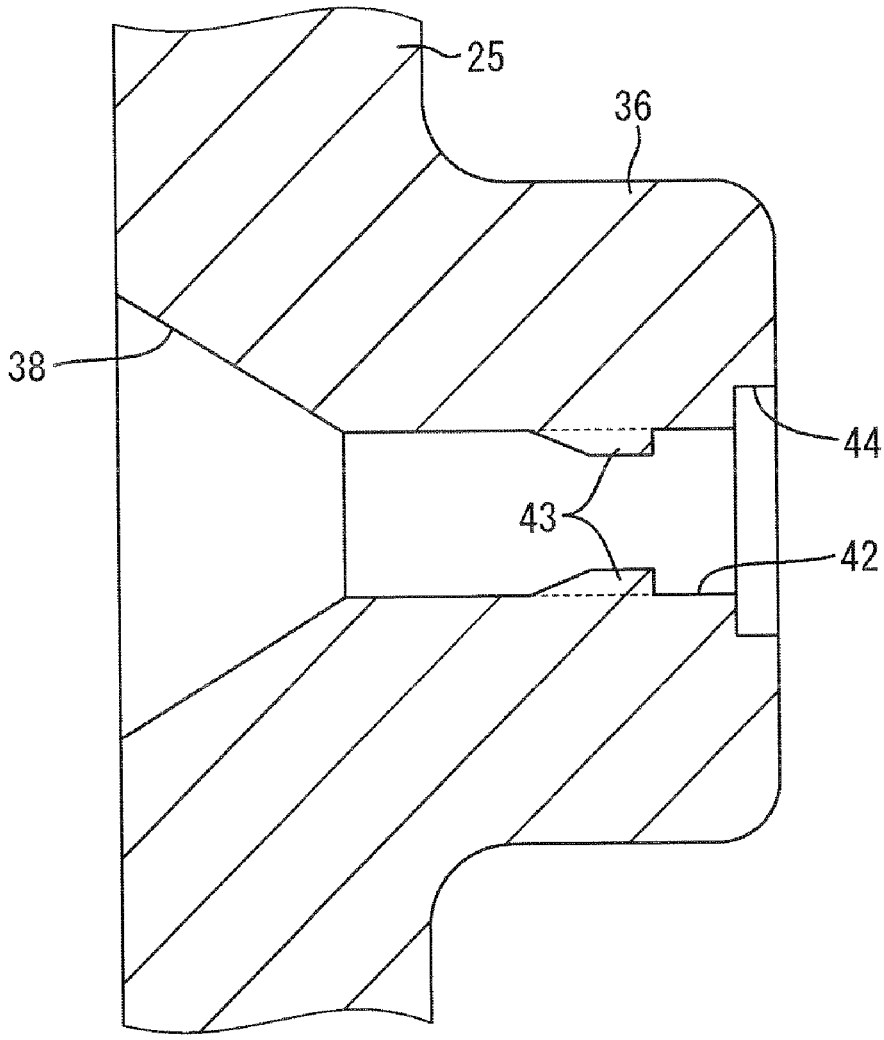
FIG. 7 is an enlarged side sectional view of the mounting hole.
Figure 8:
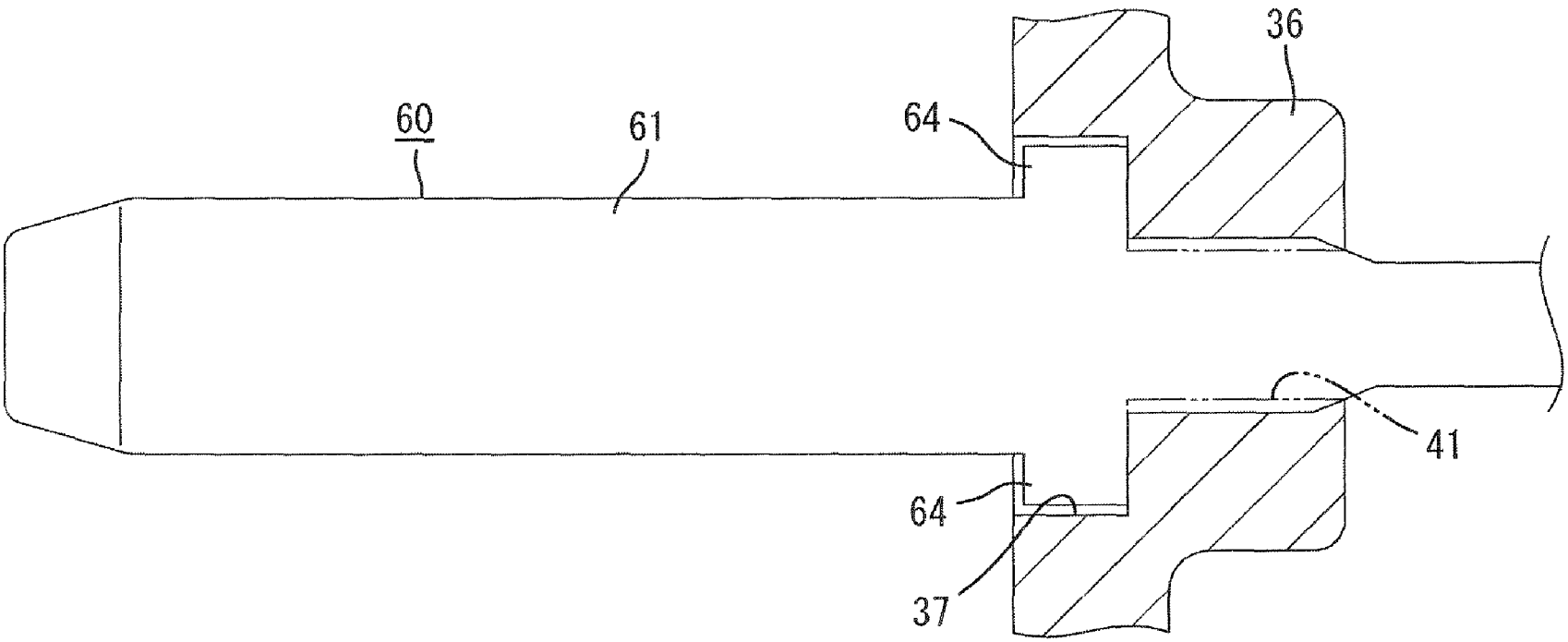
FIG. 8 is an enlarged transverse sectional view of the mounting hole into which the terminal fitting is inserted.

A wide first sectional part 37 is formed at a front side of the mounting hole 35, as shown in FIG. 8. Two removal prevention pieces 64 project from both side edges of the terminal fitting 60 and fit in the first sectional part 37. The terminal fitting 60 is prevented from being removed from the mounting hole 35 by bringing the removal prevention pieces 64 into contact with steps of the mounting hole 35 disposed at the rear of the first sectional part 37. A second sectional part 38 is formed at a front end of the mounting hole 35 and has a side sectional surface that gradually becomes vertically larger toward the front, as shown in FIGS. 6 and 7. The second sectional part 38 functions as a guide for guiding the terminal fitting 60 into the mounting hole 35. The front end of the mounting hole 35 is open on the front surface of the rear wall 25 in the shape of a wide rectangle, as shown in FIG. 2.

A third section part 41 is formed at a rear end of the mounting hole 35, as shown in FIG. 8. The third sectional part 41 is continuous with the first sectional part 37, but is stepped therefrom. Additionally, the third sectional part 41 defines a long groove-shaped transverse section with a width that is slightly narrower than the width of a corresponding portion of the terminal fitting 60. Thus, the terminal fitting 60 can be held in the third sectional part 41 in a press fit state.

A fourth sectional part 42 is formed at the rear end of the mounting hole 35 and is continuous with the rear end of the second sectional part 38, as shown in FIGS. 6 and 7. The fourth sectional part 42 has a long groove-shaped side sectional surface with a width that is equal to or slightly larger than the thickness of the terminal fitting 60. Upper and lower claws 43 project in at a middle position of the fourth sectional part 42 for interfering with the terminal fitting 60. A stepped concavity 44 is formed at a rear end of the fourth sectional part 42. The claws 43 are disposed symmetrically with respect to the axis of the mounting hole 35. A front surface of each claw 43 opens gradually forward to guide the terminal fitting 60 to the mounting hole 35, whereas a rear surface of each claw 43 is approximately orthogonal to the insertion direction of the terminal fitting 60 to prevent removal of the terminal fitting 60 from the mounting hole 35. Thus, the fourth sectional part 42 has an overlapping area in the thickness direction between the claw 43 and the terminal fitting 60 to allow the terminal fitting 60 to be held at the claw 43 in a press fit state. The claw 43 is crushed when the terminal fitting 60 passes therethrough. Shavings of the claw 43 resulting from the crushing bite into a space between the end surface of the terminal fitting 60 and the inner surface of the mounting hole 35. A region of the shavings spreads rearward in a wide range as the insertion of the terminal fitting 60 progresses into the mounting hole 35. The shavings that have reached the rear end of the rear wall 25 are received by the stepped concavity 44 and can be discarded therefrom.

As described above, the terminal fitting 60 is held in the press fit state at the rear side of the mounting hole 35 in the thickness direction and in the width direction. Thus, the terminal fitting 60 is held securely in the hood 21 in a removal-prevented state and is prevented from loosening in the width and height directions. The claw 43 is formed at only a portion of the fourth sectional part 42, and hence resistance to the insertion of the terminal fitting 60 into the mounting hole 35 is not large. Further, the claw 43 is formed at the longitudinal middle of the mounting hole 35 so that the shavings of the claw 43 spread in the gap between the end surface of the terminal fitting 60 and the inner surface of the mounting hole 35 as the insertion of the terminal fitting 60 into the mounting hole 35 progresses. Therefore, the force of holding the terminal fitting 60 in the mounting hole 35 is enhanced and securely restrains the terminal fitting 60 from loosening in the thickness direction thereof.

Figure 4:
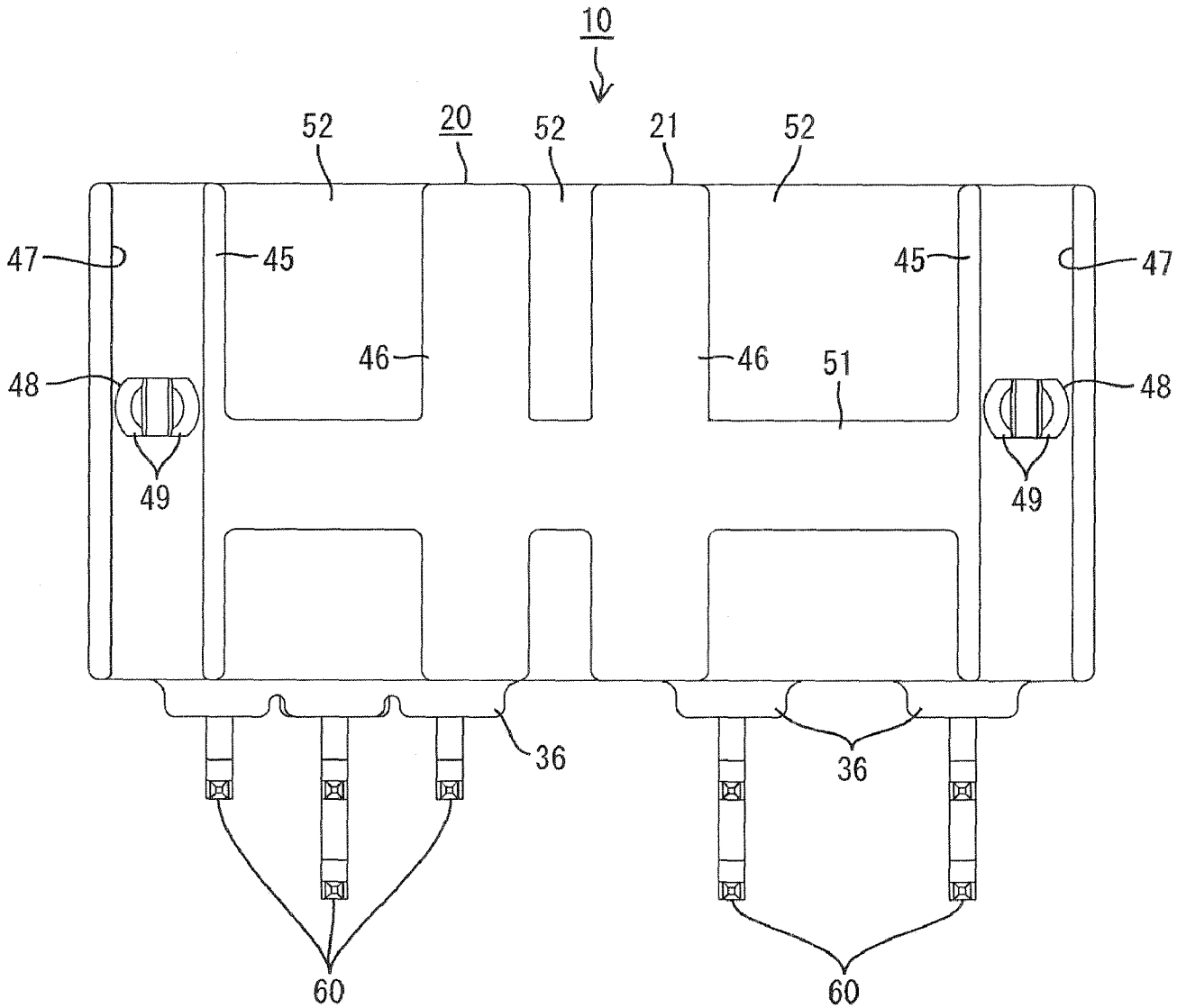
FIG. 4 is a bottom view of the connector for the substrate.

As shown in FIGS. 1 and 4, first channels 45 extend longitudinally at both widthwise sides of the bottom wall 22 of the hood 21 and project down and out from the bottom wall 22. The first channels 45 are formed in correspondence to the fit-in concavities 28 respectively so that each of the first channels 45 has an inner side surface flush and continuous with the inwardly facing surface of the side wall 24 of the corresponding fit-in concavity 28. Additionally, the first channels 45 are disposed symmetrically with respect to the center of the hood 21 in the widthwise direction as defined by the position of the partitioning wall 26.

Second channels 46 extend longitudinally at two positions in the widthwise middle of the bottom wall 22 of the hood 21 and have convex lower surfaces that project down and out from the bottom wall 22 and concave inner surfaces that face into the respective fit-in concavities 28. The concave surface of the second channel 46 in the right fit-in concavity 28 (hereinafter referred to as 28R) has a side surface flush and continuous with the surface of partitioning wall 26. However, the second channel 46 of the left fit-in concavity 28 (hereinafter referred to as 28L) is displaced laterally from the partitioning wall 26.

Projections that can fit in the first and second channels 45 and 46 are formed on each of the mating housings. As described above, the channels 45, 46 of the right fit-in concavity 28R are arranged differently than the channels 45, 46 of the left fit-in concavity 28L. Therefore the mating housing to be fit in the right fit-in concavity 28R cannot fit in the left fit-in concavity 28L. Similarly the mating housing to be fit in the left fit-in concavity 28L cannot fit in the right fit-in concavity 28R. Therefore, the mating housings cannot be fit in the wrong fit-in concavity.

Figure 3:
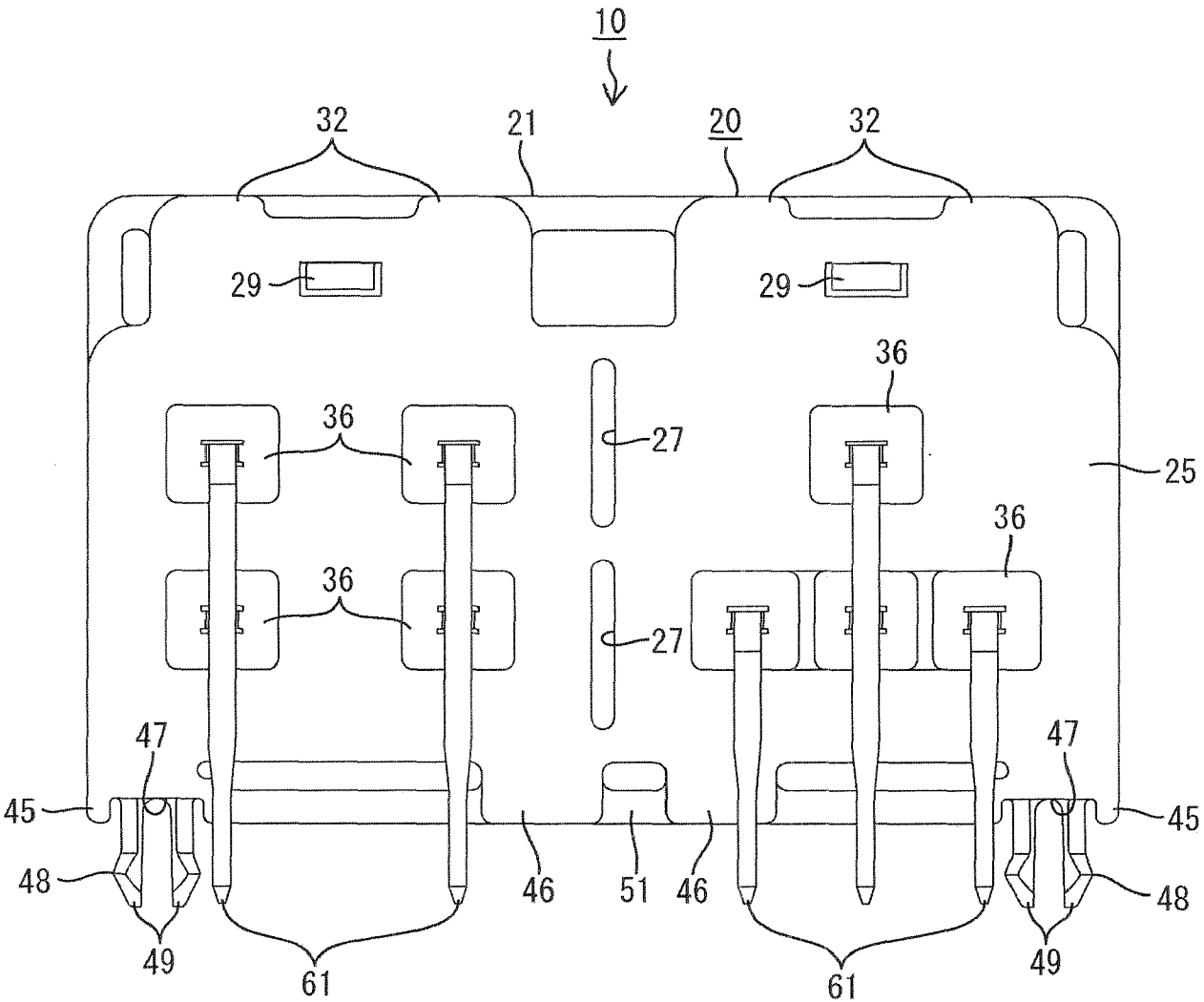
FIG. 3 is a rear view of the connector for the substrate.

Bottom surfaces of the channels 45, 46 are substantially coplanar and approximately horizontal. A downwardly-open concave groove 47 (see FIG. 4) is formed at a widthwise middle position of the bottom surface each first channel 45 and extends over the full length of the first channel 45 in the longitudinal direction thereof. The concave groove 47 of each first channel 45 is opposed to the upwardly facing concave groove of the corresponding first channel 45 with a thin wall therebetween. A mounting portion 48 projects down the horizontal base of the concave groove 47 of each first channel 45 at a position slightly forward from the longitudinal center of the concave groove 47 and is configured for mounting the hood 21 on the circuit substrate 90. Each of the mounting portions 48 has counterparts 49 (see FIG. 4) that can be opened widthwise and can be elastically locked to a peripheral edge of the through-hole 92 formed through the circuit substrate 90. A lower end of the mounting portion 48 is located below the lower end of the vertical part 62 of the terminal fitting 60. Thus, the mounting portion 48 is inserted into the through-hole 92 before the vertical part 62 is inserted into a corresponding connection hole 93 (see FIG. 2). As shown in FIG. 3, the mounting portion 48 projects from the base surface of the concave groove 47, and the projected amount of the mounting portion 48 increases by the depth of the concave groove 47. Thus a smooth elastic operation of the counterparts 49 can be accomplished securely.

A lower reinforcing rib 51 (see FIGS. 1, 3) extends widthwise along the bottom surface of the bottom wall 22 at a position slightly rearward from the longitudinal center of the bottom wall 22. Widthwise middle areas of the lower reinforcing rib 51 are connected orthogonally with the second channels 46. Widthwise ends of the lower reinforcing rib 51 are connected with the first channels 45 at approximately right angles. The bottom surface of the lower reinforcing rib 51 is continuous, flush and coplanar with bottom surfaces of the channels 45, 46. Square concave recesses 52 (see FIG. 4) are spaced from one another in regions surrounded by the channels 45, 46 of the bottom wall 22 and the lower reinforcing rib 51.

The connector is assembled by first press fitting the terminal fittings 60 into the mounting hole 35 of the rear wall 25 from the front. Rear portions of the terminal fittings 60 that project rearward from the rear wall 25 then are bent down. The hood 21 then is placed on the circuit substrate 90 so that the mounting portions 48 are inserted into the corresponding through-holes 92 and so that the terminal fittings 60 are inserted into the corresponding connection holes 93. The front ends of the counterparts 49 of the mounting portions 48 are locked elastically to the peripheral edges of the through-hole 92 formed through the circuit substrate 90 when the mounting portions 48 are inserted sufficiently into the through-hole 92, as shown in FIGS. 1 and 2. Thus, the hood 21 is fixed to the circuit substrate 90 in an unremovable state. The terminal fittings 60 then are connected to the electric path of the connection hole 93 by manual soldering or reflow soldering.

The inner surfaces of the concavities 52 do not contact the upper surface of the circuit substrate 90 when the hood 21 is mounted on the circuit substrate 90. However, the bottom surfaces of the channels 45, 46 and the bottom surface of the lower reinforcing rib 51 contact the upper surface of the circuit substrate 90. Thus, the hood 21 is supported stably on the circuit substrate 90. Thereafter the corresponding mating housings are fit in the respective fit-in concavities 28 of the hood 21 to connect the mating terminal fittings mounted in the mating housings to the corresponding terminal fittings 60. At this time, an operation of fitting the mating housings into the fit-in concave portions 28 is guided by the guide groove 32 and the channels 45, 46, with the channels 45, 46 preventing each mating housing from being fit in the wrong fit-in concavity 28.

As described above, the outer surfaces of the channels 45, 46 for preventing the mating housing from being fit in the wrong fit-in concavity 28 contact the upper surface of the circuit substrate 90. Thus, it is unnecessary to provide the connector with a dedicated supporting construction for the circuit substrate 90. Therefore the construction of the hood 21 is not complicated, material is reduced and costs are lower. Further the groove channels 45, 46 extend longitudinally at both widthwise ends of the bottom wall 22 of the hood 21 and project out from the bottom wall 22. Therefore this construction allows the hood 21 to be thermally affected to a lower extent by the circuit substrate 90 than the construction in which the entire bottom surface of the hood 21 contacts the circuit substrate 90, while still ensuring that the hood 21 is supported stably by the circuit substrate 90.

The mounting portions 48 project on the base surfaces of the concave grooves 47 of the channels 45, 46. Thus, space is utilized more efficiently than the construction in which the mounting portion 48 is separate from the channels 45, 46. Further because a part of the projected amount of the mounting portion 48 is covered by the channels 45, 46, the material cost can be saved.

Because the hood 21 is wide thereof, there is a fear that the hood part 21 is warped by an external force. However, the external force can be received by the surface of contact between the circuit substrate 90 and the channels 45, 46 formed at the middle position of the hood 21 in its widthwise direction. Thus, the hood 21 is not likely to warp.

The bottom surfaces of the channels 45, 46 are flat and are disposed along the upper surface of the circuit substrate 90. Thus, compared with the case where the end surfaces of the channels 45, 46 draw an arc, it is possible to make the height of the channels 45, 46 small and the hood 21 compact. Further the hood 21 can be stably supported by the circuit substrate 90.

The lower reinforcing rib 51 extends along the bottom surface of the bottom wall 22 of the hood 21 in the widthwise direction. Therefore the hood 21 is not likely to be warped by heat or an external force.

The invention is not limited to the embodiment described above with reference to the drawings. For example, the following embodiments are included in the technical scope of the invention.

It is possible to omit the formation of at least one of the second channels, the upper reinforcing portion, the lower reinforcing rib, the guide groove, and the partitioning wall.

It is possible not to form the concave groove on the second channel and form the entire end surface of the second channel as a flat surface.

The lower reinforcing rib may have its lower surface above the bottom surface of the hood.

The first channel does not necessarily have to be formed over the entire length of the hood in the longitudinal direction thereof, but may be formed partly or intermittently.

The mounting portion may be formed at a position other than the base surface of the concave groove in the lower part of the first channel.

The first and second channels may have a function of preventing the mating housing from being fit in the wrong fit-in concavity with the mating housing turned upside down.

What is claimed is:

1. A connector for a circuit substrate comprising: a tubular hood having an open front end in which at least one mating housing can be fit and a rear end spaced from the front end along a front to rear direction, the hood having a bottom wall and opposite side walls extending up from opposite widthwise sides of the bottom wall, channels projecting out from the bottom wall of the hood and extending in the front to rear direction from the front end of the hood, each of the channels defining a concave groove facing inwardly into the hood and having at least one external convex supporting surface facing outwardly and away from the hood and disposed at a position spaced below the bottom wall, the convex support surfaces of the channels being mountable on a surface of a circuit substrate.

2. The connector of claim 1, further comprising at least one mounting portion projecting down from at least one of the channels for elastically locking to a peripheral edge of a through-hole formed through said circuit substrate for preventing said hood from being removed from said circuit substrate.

3. The connector of claim 2, wherein at least one of the channels has a concave area facing down and away from the hood, the mounting portion (48) projecting from a surface of the concave area.

4. The connector of claim 1, wherein the channels include at least one channel formed at a substantially middle position of the bottom wall of the hood in a widthwise direction thereof.

5. The connector of claim 1, wherein the external convex supporting surfaces of the channels have substantially flat bottom surfaces that are substantially coplanar for supporting the hood on the circuit substrate.

6. The connector of claim 1, further comprising a reinforcing rib projecting out from the bottom wall of the hood and extending transverse to the channels.

7. The connector of claim 6, wherein the reinforcing rib has a bottom surface that is substantially coplanar with bottom surfaces of the channels.

8. The connector of claim 7, wherein the reinforcing rib the channels at substantially right angles.

9. The connector of claim 8 wherein recesses are formed in the bottom wall at positions bounded by the reinforcing rib and the channels.

10. The connector of claim 1, wherein the channels include first channels substantially adjacent the respective side walls and at least one second channel between the first channels.

11. The connector of claim 10, further comprising a top wall opposed to the bottom wall, a partitioning wall extending from the bottom wall to the top wall at a position between the side walls for forming two concavities in the hood, the at least one second channel comprising two second channels aligned respectively with the two concavities.

12. The connector of claim 11, wherein the second channels are disposed asymmetrically with respect to the partitioning wall.

13. A connector for a circuit substrate comprising: a tubular hood having a bottom wall, opposite side walls extending up from opposite widthwise sides of the bottom wall, a top wall connecting the side walls and opposed to the bottom wall, the hood further having an open front end and a rear wall spaced from the front end in a front to rear direction, a partitioning wall extending between the bottom and top walls at a position between the side walls for defining concavities between the partitioning wall and the side walls, first channels projecting out from the bottom wall of the hood at positions substantially adjacent the side walls and extending in the front to rear direction from the front end of the hood, second channels projecting out from the hood at positions in proximity to the partitioning wall and extending in the front to rear direction from the front end of the hood, each of the channels having a concave groove facing inwardly into the hood and at least one external convex supporting surface facing downwardly and away from the hood at a position spaced below the bottom wall, the external convex supporting surfaces of the channels being mountable on a surface of a circuit substrate.

14. The connector of claim 13, further comprising mounting portions projecting down from the first channels for elastically locking to a peripheral edge of a through-hole formed through said circuit substrate for preventing said hood from being removed from said circuit substrate.

15. The connector of claim 14, wherein the external convex supporting surfaces of the first channels each have a concave areas facing down and away from the hood, the mounting portions projecting from surfaces of the concave areas.

16. The connector of claim 13, wherein the channels have substantially flat bottom surfaces that are substantially coplanar for supporting the hood on the circuit substrate.

17. The connector of claim 13, further comprising a reinforcing rib projecting out from the bottom wall of the hood and extending transverse to the channels.

18. The connector of claim 17, wherein the reinforcing rib has a bottom surface that is substantially coplanar with bottom surfaces of the channels.

19. The connector of claim 18, wherein the reinforcing rib intersects the channels at substantially right angles.

20. The connector of claim 19 wherein recesses are formed in the bottom wall at positions bounded by the reinforcing rib and the channels so that the recesses are spaced up from the circuit substrate when the channels are mounted on the circuit substrate.

21. The connector of claim 13 wherein the second channels are positioned asymmetrically to the partitioning wall for preventing mating housings from being fit in wrong concavities of the hood.

* * * * *